US008061410B2

(12) United States Patent
Machanek

(10) Patent No.: US 8,061,410 B2
(45) Date of Patent: Nov. 22, 2011

(54) HEAT EXCHANGER BLOCK

(75) Inventor: Norbert Machanek, Notzingen (DE)

(73) Assignee: Modine Manufacturing Company, Racine, WI (US)

( * ) Notice: Subject to any disclaimer, the term of this patent is extended or adjusted under 35 U.S.C. 154(b) by 1377 days.

(21) Appl. No.: 10/813,739

(22) Filed: Mar. 31, 2004

(65) Prior Publication Data

US 2004/0250988 A1 Dec. 16, 2004

(30) Foreign Application Priority Data

May 16, 2003 (DE) ..... 103 22 211

(51) Int. Cl.
*F28F 7/00* (2006.01)
*B60H 1/00* (2006.01)

(52) U.S. Cl. ..... 165/76; 165/140; 165/41; 180/68.1; 180/68.4

(58) Field of Classification Search ..... 165/41, 165/42, 43, 44, 67, 76, 140, 144, 145; 180/68.1, 180/68.4
See application file for complete search history.

(56) References Cited

U.S. PATENT DOCUMENTS

| | | | | | |
|---|---|---|---|---|---|
| 1,770,208 | A | | 7/1930 | Kemnal | |
| 1,805,101 | A | * | 5/1931 | Modine | 165/140 |
| 1,847,743 | A | | 3/1932 | Anderson | |
| 1,974,402 | A | * | 9/1934 | Templeton | 165/144 |
| 2,013,186 | A | * | 9/1935 | Price | 165/144 |
| 2,044,457 | A | * | 6/1936 | Young | 165/144 |
| 2,184,657 | A | * | 12/1939 | Young | 165/144 |
| 2,209,974 | A | | 8/1940 | Jacobus | |
| 2,237,516 | A | * | 4/1941 | Young | 165/144 |
| 2,258,041 | A | | 10/1941 | Young | |
| 2,308,119 | A | * | 1/1943 | Spieth | 165/144 |
| 2,327,491 | A | * | 8/1943 | Blais | 165/144 |
| 2,443,703 | A | * | 6/1948 | Christensen | 165/144 |
| 2,505,790 | A | * | 5/1950 | Panthofer | 165/140 |
| 2,984,456 | A | * | 5/1961 | Young | 165/145 |
| 4,125,280 | A | | 11/1978 | Kuzel | |
| 4,137,982 | A | * | 2/1979 | Crews et al. | 180/68.4 |
| 4,202,407 | A | * | 5/1980 | Woitowitz | 165/76 |
| 4,254,819 | A | | 3/1981 | Worrell | |
| 4,295,521 | A | * | 10/1981 | Sommars | 165/144 |
| 4,369,837 | A | | 1/1983 | Moranne | |
| 4,501,321 | A | | 2/1985 | Real et al. | |
| 4,651,816 | A | * | 3/1987 | Struss et al. | 165/76 |
| 4,706,461 | A | * | 11/1987 | Pratt et al. | 165/44 |

(Continued)

FOREIGN PATENT DOCUMENTS

DE 4 009 726 A1 10/1991

(Continued)

*Primary Examiner* — Ljiljana Ciric
(74) *Attorney, Agent, or Firm* — Michael Best & Friedrich LLP

(57) ABSTRACT

A heat exchanger block including at least two heat exchangers each including a pair of longitudinal headers with tubes extending between the headers, at least some of which are aluminum cast parts. Adjacent heat exchangers are detachably connected at adjacent ends of their headers wherein one of the adjacent headers includes a recessed portion in the adjacent end and the other of the adjacent headers includes a flange receivable in the recess of the one header. Matching holes extend through the flange and the one header end, and a fastener extends through the matching holes in the ends of at least one set of adjacent headers. Shroud attachments are along a longitudinal wall of at least one of the longitudinal headers.

39 Claims, 5 Drawing Sheets

U.S. PATENT DOCUMENTS 4,805,693 A 2/1989 Flessate
4,997,033 A * 3/1991 Ghiani et al. ..... 165/67
5,052,475 A 10/1991 Grundy
5,127,466 A * 7/1992 Ando ..... 165/67
5,174,372 A 12/1992 Potier et al.
5,197,538 A * 3/1993 Nagasaka et al. ..... 165/144
5,226,235 A 7/1993 Lesage
5,234,051 A * 8/1993 Weizenburger et al. ..... 165/41
5,299,636 A 4/1994 Potier
5,301,748 A 4/1994 Potier
5,303,770 A * 4/1994 Dierbeck ..... 165/140
5,311,934 A 5/1994 Potier
5,325,915 A * 7/1994 Fouts et al. ..... 165/144
5,429,181 A * 7/1995 Tordjeman ..... 165/67
5,476,138 A * 12/1995 Iwasaki et al. ..... 180/68.4
5,490,560 A 2/1996 Helms et al.
5,511,613 A 4/1996 Mohn et al.
5,535,821 A 7/1996 Potier
5,538,079 A 7/1996 Pawlick
5,566,748 A * 10/1996 Christensen ..... 165/67
5,671,803 A * 9/1997 Tepas et al. ..... 165/67
RE35,710 E * 1/1998 Shinmura ..... 165/140
5,720,341 A * 2/1998 Watanabe et al. ..... 165/140
5,894,649 A 4/1999 Lambert et al.
6,318,450 B1 * 11/2001 Acre ..... 165/67
6,330,747 B1 12/2001 Lambert et al.
6,460,610 B2 10/2002 Lambert et al.
6,527,046 B1 * 3/2003 White ..... 165/144
6,601,640 B1 * 8/2003 Staffa et al. ..... 165/67
6,817,404 B2 * 11/2004 Frana-Guthrie et al. ..... 165/43
6,843,097 B2 1/2005 Tatsuta et al.
6,874,570 B2 * 4/2005 Horiuchi ..... 165/140
6,907,916 B2 * 6/2005 Koyama ..... 165/67
6,928,730 B2 8/2005 Beldam et al.
6,988,532 B2 * 1/2006 Hamada ..... 165/67
7,036,561 B2 * 5/2006 Yagi et al. ..... 165/67
7,073,571 B2 * 7/2006 Yu et al. ..... 165/140
7,108,049 B2 * 9/2006 Makino et al. ..... 165/67
7,131,488 B2 * 11/2006 Ozaki ..... 165/140
7,143,824 B2 12/2006 Emrich et al.
7,147,046 B2 * 12/2006 Sanada et al. ..... 165/140
7,284,594 B2 * 10/2007 Sanada et al. ..... 165/41
7,303,002 B2 12/2007 Usui et al.
7,392,837 B2 * 7/2008 Makino et al. ..... 165/140
7,520,318 B2 * 4/2009 Kwon ..... 165/140
7,637,309 B2 * 12/2009 Contet ..... 165/67
2005/0161206 A1 7/2005 Ambros et al.
2005/0263263 A1 12/2005 Merklein et al.
2006/0201663 A1 9/2006 Strahle et al.
2008/0264609 A1 10/2008 Lutz et al.
2009/0235662 A1 9/2009 Knafl et al.
2009/0260605 A1 10/2009 Janssen et al.

FOREIGN PATENT DOCUMENTS

DE 195 09 654 A1 9/1996
EP 0 515 924 A 12/1992

* cited by examiner

HEAT EXCHANGER BLOCK

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to heat exchangers, and more particularly to heat exchanger blocks having a plurality of heat exchangers connected together.

BACKGROUND OF THE INVENTION AND TECHNICAL PROBLEMS POSED BY THE PRIOR ART

Heat exchanger blocks are known, for example, from European Patent Application 0 515 924 A, in which multiple heat exchangers are screwed to each other in a manner not further shown, with the collecting tank or header for the coolant cooler integrated in the collecting tank or header for the oil cooler. Detachably assembled heat exchanger blocks are advantageous because detachable connection of the heat exchangers can be relatively stable, with no additional frame parts, rails, or the like being required. However, such connections can be difficult in a variety of applications, for example when the heat exchanger block consists of heat exchangers which are different in size, configuration and/or purpose.

DE 4 009 726 A1 and also in DE 195 09 654 A1 are also material prior art for heat exchanger blocks. For example, DE 195 09 654 A1 show use of two common (i.e., one-piece) collecting tanks or headers which are allocated to the different heat exchangers. While this may be advantageously used with heat exchanger blocks in which the heat exchangers do not vary in size, it also poses problems when the heat exchanger block is to be assembled from heat exchangers of different sizes. Further, the heat exchangers in DE 195 09 654 A1 also appear not to be thermally separated from each other, and as a result the heat from one heat exchanger can readily reach the adjacent heat exchanger, which is not desirable in many cases (e.g., where the heat exchangers are intended to operate in different temperature ranges).

A heat exchanger block consisting of a water cooler and an oil cooler is disclosed in 1946 U.S. Pat. No. 2,505,790, in which the two coolers are joined in the region of the narrow sides of the collecting tanks or headers, either detachably by screws through protruding shoulders, or by undetachably joining the sides (i.e., in one variant depicted there, two collecting tanks are combined as a single part, which was fastened detachably on the tube plate). A profiled support is arranged (see its FIGS. 1-2) as a single part between the narrow sides of the collecting tanks or headers, which support extends between the opposite collecting tanks and is additionally screwed to the long walls of the collecting tanks. The design layout of the connection appears to be demanding and no longer timely. Moreover, the profiled support hampers the development of the standardized joining technique.

The present invention is directed toward overcoming one or more of the problems set forth above.

SUMMARY OF THE INVENTION

In one aspect of the present invention, a heat exchanger block is provided, including at least two heat exchangers each consisting of a pair of longitudinal headers with tubes extending between the headers. Adjacent heat exchangers are detachably connected at adjacent ends of their headers wherein one of the adjacent headers includes a recessed portion in the adjacent end and the other of the adjacent headers includes a flange receivable in the recess of the one header. Matching holes extend through the flange and the one header end, and a fastener extends through the matching holes in the ends of at least one set of adjacent headers.

In one form of this aspect of the invention, at least some of the headers are aluminum cast parts.

In another form of this aspect of the invention, shroud attachments are along a longitudinal wall of at least one of the longitudinal headers.

In yet another form of this aspect of the invention, an intermediate insert is between the tubes of the adjacent headers, the insert having a low thermal conductivity.

In still another form of this aspect of the invention, the fastener extends between the front and back of the heat exchanger block.

In another form, the matching holes are each longitudinal with an oblong cross-section in a plane perpendicular to the longitudinal direction of the holes. In a further form, the oblong cross-sections each have a major dimension, and the major dimension of one oblong cross-section is transverse to the major dimension of the other oblong cross-section.

In yet another form of this aspect of the invention, the heat exchanger block is a cross-flow heat exchanger block in which the headers are arranged on two vertically-aligned rows.

In still another form, adjacent headers jointly define a substantially longitudinally extending outer profile, and the flange does not extend substantially outside the outer profile.

In another form, the flat tubes together with fins define a core for each heat exchanger, and the cores of all of the heat exchangers are substantially aligned on at least one side in a plane. In one further form, the plane is substantially vertical and in another form the flange extends substantially parallel to the plane.

In yet another form, fan mounting arms are provided with arm attachments along a longitudinal wall of at least one of the longitudinal headers.

In still another form, a first flange is on one of the heat exchangers and a second is on flange on a second of the heat exchangers, with aligned holes on the flanges, and a connector extends through the aligned holes in the longitudinal direction of the headers. In a further form, the connector permits different heat-related length changes between the first and second flanges.

In yet another form of this aspect of the invention, a shape-mated joint is provided between at least one pair of adjacent heat exchangers. In further form, the shape-mated joint secures the one pair of adjacent heat exchangers against relative movement in the longitudinal direction of the headers and permits relative movement in a direction transverse to the longitudinal direction.

In another aspect of the present invention, a heat exchanger block is provided, including at least two heat exchangers each consisting of a pair of longitudinal headers with tubes extending between the headers, at least some of which are aluminum cast parts. Adjacent heat exchangers are detachably connected at adjacent ends of their headers wherein one of the adjacent headers includes a recessed portion in the adjacent end and the other of the adjacent headers includes a flange receivable in the recess of the one header. Matching holes extend through the flange and the one header end, and a fastener extends through the matching holes in the ends of at least one set of adjacent headers. Shroud attachments are along a longitudinal wall of at least one of the longitudinal headers.

BRIEF DESCRIPTION OF THE DRAWINGS

The invention will be described below in practical examples. Features and effects that are particularly noteworthy can be mentioned in the description, even if they were not mentioned above.

DETAILED DESCRIPTION OF THE INVENTION

Figure 2:
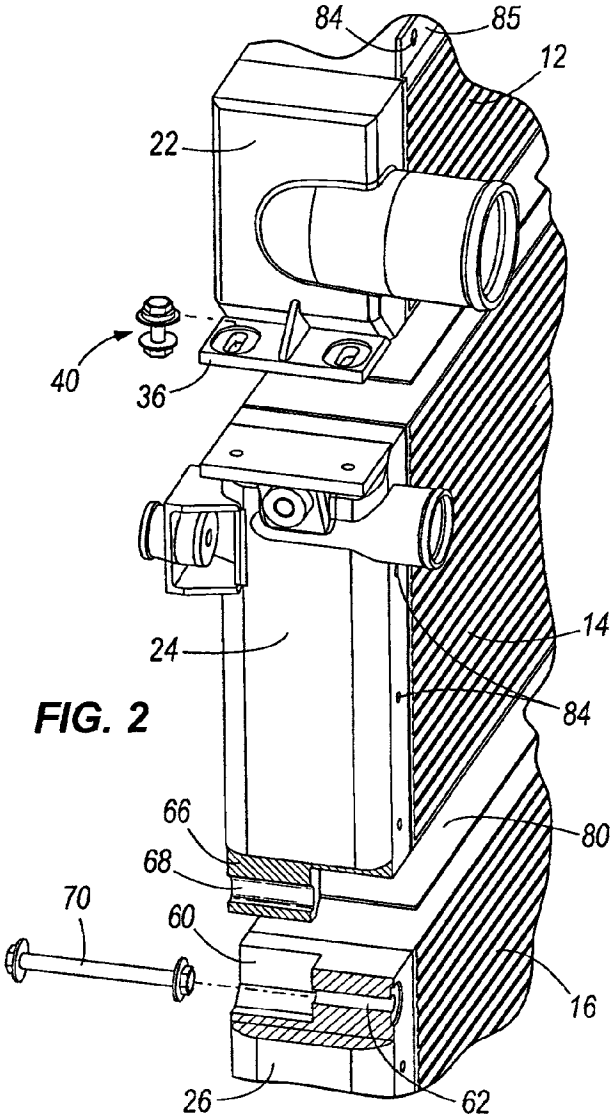
FIG. 2 is an exploded partially cut-away view of the upper left corner of the heat exchanger block of FIG. 1.

The Figures illustrate a heat exchanger block 10 according to the present invention. The heat exchanger block 10 may be advantageously used, for example, with vehicles in the off-highway sector (e.g., with a construction machine or agricultural machine). In accordance with the invention, the block 10 may consist of a plurality of separate heat exchangers, such as the illustrated three heat exchangers 12, 14, 16. As further described below, the heat exchangers 12, 14, 16 are secured with their collecting tanks or headers 22, 24, 26 in alignment with one another. The heat exchangers 12, 14, 16 may have different depths, in which case one side (e.g., the rear face relative to the direction of travel when used in a vehicle) may be aligned in generally the same (vertical) plane, with the other side (e.g., the front face) adapted to for equalization.

The heat exchangers 12, 14, 16 may each be configured in any suitable, desired manner according to the heat exchanging requirements of the systems with which they are used. For example, the heat exchangers may each include flat tubes 28 extending between the headers 22, 24, 26, with corrugated fins or ribs 29 (see particularly FIG. 9) between the tubes 28. It should be understood, however, that the core formed by the flat tubes 28 and fins 29 could be of virtually any heat exchanging configuration including, for example, tubes passageways formed in different manners, tubes which are different in size, shape, and/or number (including different internal structures, including multi-port tubes), fins of different configurations such as plate fins, different materials, and different flow configurations (e.g., single pass and/or multipass).

The headers 22, 24, 26 are generally configured to extend longitudinally in two vertically aligned rows, with the headers being formed by longitudinal walls connected along their edges to define an enclosed space, with smaller end walls connected to the ends of the longitudinal walls to close the enclosed space. The heat exchanger block 10 may thus be advantageously designed as a cross-flow heat exchanger block 10. Further, the heat exchangers 12, 14, 16 of the heat exchanger block 10 are preferably arranged with their headers 22, 24, 26 at least in one common vertical plane in order to be able to favorably mount a fan shroud thereon as described in greater detail below.

The headers 22, 24, 26 may advantageously be aluminum cast products, although they need not be. In accordance with the present invention, the heat exchangers 12, 14, 16 are preferably generally the same width (i.e., same tube lengths), but can have different sizes in terms of block depth and block height.

In accordance with the present invention, the adjacent heat exchangers 12, 14, 16 may be secured together by securing their headers 22, 24, 26 in an end to end fashion.

Figure 3:
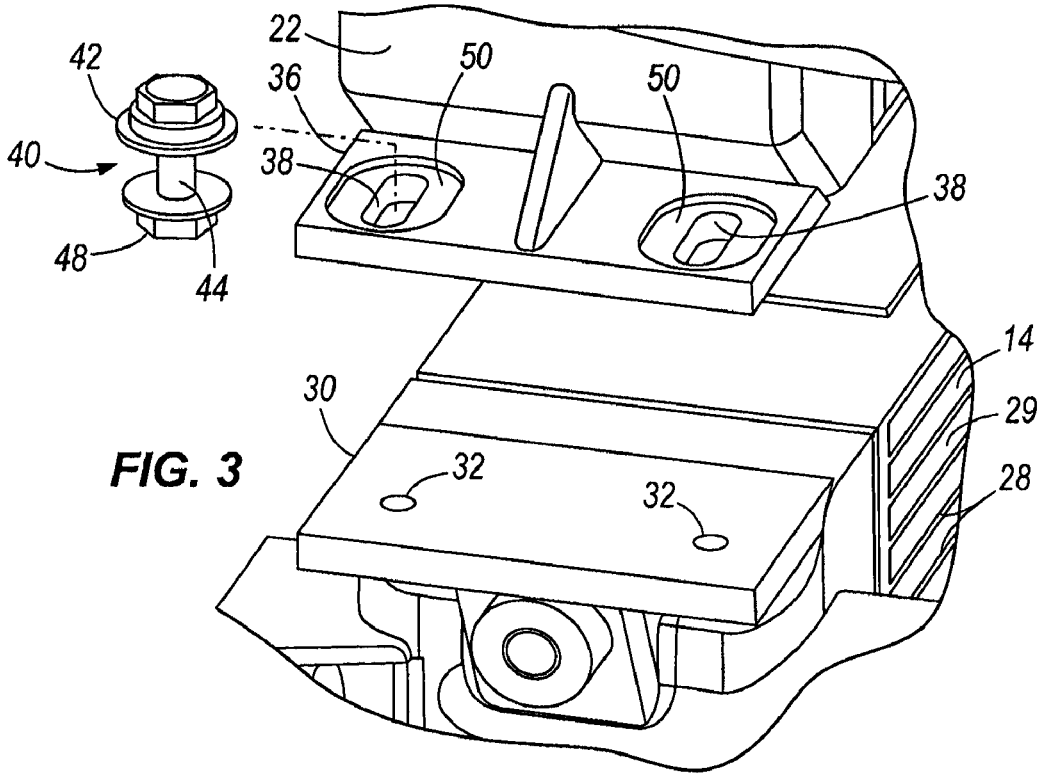
FIG. 3 is detailed view A from FIG. 2.
Figure 5:
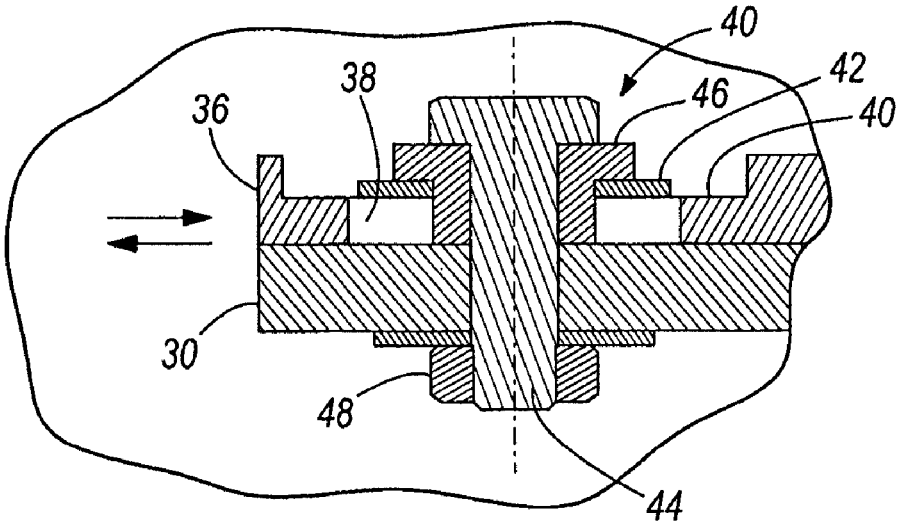
FIG. 5 is a cross sectional view of the connection illustrated in exploded form in FIG. 3.

In accordance with one embodiment of the invention particularly illustrated in FIGS. 2, 3 and 5, the upper end of the header 24 of the middle heat exchanger 14 includes a flange 30 extending outwardly from the header 24, and includes two holes 32 therein. The lower end of the header 22 of the upper heat exchanger 12 also includes a flange 36, which flange 36 includes two holes 38 which are oblong in the lateral direction of the heat exchanger 12.

The heat exchangers 12, 14 are detachably connected by the detachable connection together of the flanges 30, 36 by fastening devices or fasteners 40 extending through aligned holes 32, 38, as shown particularly in FIGS. 3 and 5. The fasteners 40 include a corrugated plain washer 42 (whose corrugation makes a spring force available similar to that of an elastic ring) and a screw 44. The head of the screw 44 is supported on a sleeve 46 provided with a collar, through which the stem of screw 44 extends. The washer 42 is situated beneath the collar of the sleeve 46, A nut 48 is on the other end of the screw 44 so as to secure the flanges 30, 36 together. Further, the sleeve 46 may advantageously have a length in the direction of the step of the screw 44 that is slightly smaller than the height of the corrugation of plain washer 42. Accordingly, the screw 44 and nut 48 may be tightened until the sleeve 46 abuts the shoulder 50 on flange 30, thus preventing further tightening of the screw 44 and nut 48 connection. In this position, the corrugation of the washer 42 is compressed in the elastic region in the direction of the stem of the screw 44 so that the spring force resulting from this counteracts loosening of the screw 44.

It should be appreciated that the above described fastening devices 40, flanges 30, 36 and holes 32, 38 are designed as a so-called sliding seat in order to permit different relative lateral expansions of the heat exchangers 12, 14, such as can result from temperature differences (such as may occur when one heat exchanger 12 or 14 operates in a higher temperature range than the adjacent heat exchanger 14 or 12). This is often true, for example, for charge air coolers. It should also be appreciated that the described fasteners 40 function to ensure that the tightening forces do not exceed certain limits (so that they will not hamper free expansion) while also ensuring that the connection is tight enough that it does not loosen even under operating conditions.

Figure 4:
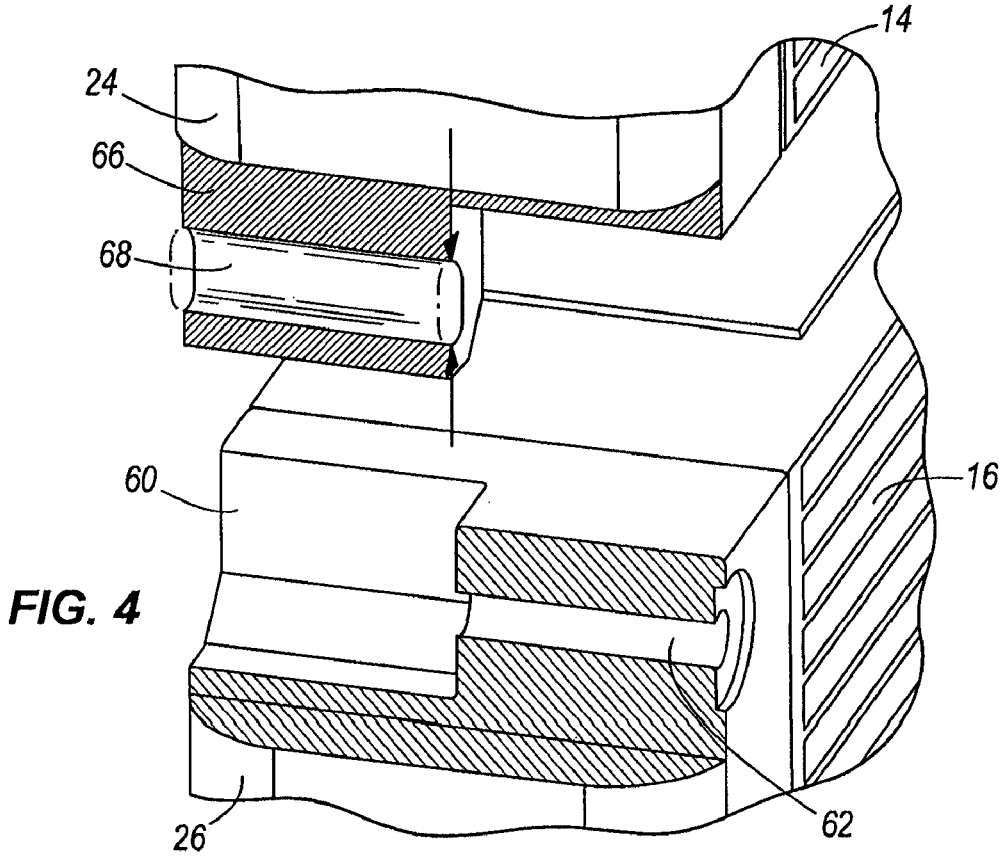
FIG. 4 is detailed view B from FIG. 2.
Figure 6:
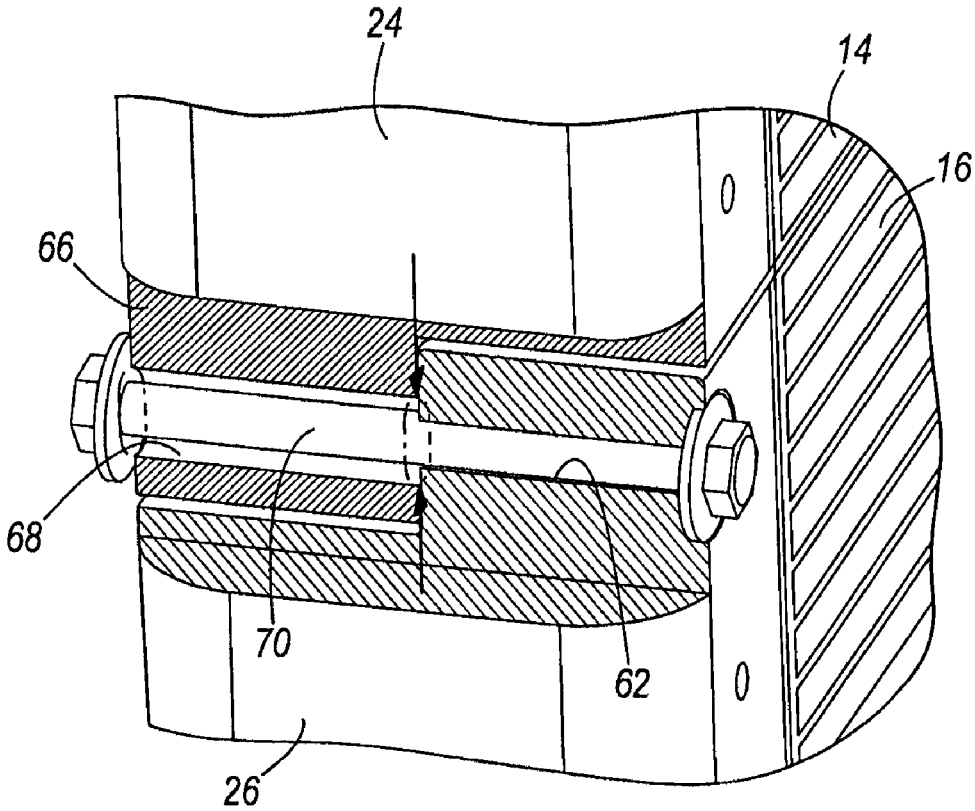
FIG. 6 is a perspective, partially cut-away view of the connection illustrated in exploded form in FIG. 4.

In accordance with another embodiment of the present invention particularly illustrated in FIGS. 2, 4 and 6, the upper end of the header 26 of the bottom heat exchanger 16 includes a recessed portion 60 on one side (e.g., the rear), and a longitudinal recess or hole 62 extending along the depth of the header 26 from other side (e.g., the front) to the recessed portion 60. The lower end of the header 24 of the middle heat exchanger 14 includes a longitudinally (downwardly) extending flange 66 which is receivable in the recessed portion 60 of the bottom heat exchanger header 26 when mounted together. It should be appreciated from the Figures that the recessed portion 60 and flange 66 cooperate so that they do not protrude beyond the outer contour of the headers 24, 26, which therefore present an outer profile at their connection which is substantially uniform with the outer profile of the headers 24, 26 generally. The flange 66 also includes a longitudinal recess or hole 68 which is aligned with the longitudinal hole 62 in the header 26 of the bottom heat exchanger 16. (It should be recognized that FIGS. 2, 4 and 6 have been cut away to show the holes 62, 68).

A suitable fastener 70, such as a nut, bolt, and washers may be extended through the aligned holes 62, 66 to secure the heat exchangers 14, 16 together as illustrated in FIG. 6, with the fastener 70 extending in the direction of the depth of the block 10.

The longitudinal holes 62, 66 may advantageously be shaped so as to be oblong in different directions to allow for thermal expansion. That is, the holes 62, 66 may be non-cylindrical with, for example, one hole 62 having a greater vertical than horizontal dimension and the other hole 66 having a greater horizontal than vertical dimension. Alternatively, both holes could have a greater dimension in the same direction (e.g., horizontally or vertically). It should be appreciated that holes 62, 66 configured in this manner may facilitate assembly as well as reduce manufacturing costs, because the requirements for accuracy (tolerances) need not be particularly high. Further, such holes 62, 66 may advantageously allow for different relative thermal expansions of the heat exchangers 14, 16 in various directions.

As is particularly apparent from FIG. 2, the fasteners 40 extend in the direction of the height of the heat exchanger block 10, whereas fasteners 70 extend in the direction of the depth of the heat exchanger block 10 (i.e., transversely to the fasteners 40), and thus different securement may be provided by the different embodiments according to design considerations of the heat exchanger block. Thus, it should be appreciated that heat exchanger blocks may be provided with more or less than two heat exchangers, and with different combinations of one or the other or both types of connections such as described above, again depending on the design considerations of the particular heat exchanger block.

An insert 80 having low thermal conductivity (e.g., made of a material having such a characteristic, such as plastic) may also be provided between adjacent heat exchangers (one being shown between the middle and bottom heat exchangers 14, 16 in FIG. 2) in order to suppress thermal effects between adjacent heat exchangers as may occur, for example, in a heat exchanger block 10 in which the upper heat exchanger 12 is a charge air cooler, the middle heat exchanger 14 is an oil cooler, and the bottom heat exchanger 16 is a coolant cooler (since such heat exchangers 12, 14, 16 do not necessarily operate in the same temperature ranges).

Suitable shroud attachments 84 (e.g., threaded screw holes) may also advantageously be provided on the longitudinal walls of the headers 22, 24, 26, as well in the end pieces 85 (see FIG. 2) of the upper and lower heat exchangers 12, 16, whereby a fan shroud 86 (see FIG. 1) may be readily attached to the heat exchanger block 10 (e.g., by screws around the perimeter of the shroud 86). Typically, the shroud 86 will be attached to the rear of the block 10 (with the front being in the direction of travel of a vehicle with which the structure may be used), in which case the headers 22, 24, 26 may be advantageously secured together so that their rear longitudinal surfaces are substantially aligned in a vertical plane, thereby allowing the fan shroud 86 to be configured simply and/or to dispense with the need for an equalization piece to make up for an uneven face (e.g., if the heat exchangers 12, 14, 16 are of different depths, in which case any equalization, if necessary, can be accomplished on the front of the heat exchanger block 10).

Additional attachments 90 (such as threaded holes) may also be provided in the longitudinal walls of the headers 22, 24, 26, for suitably securing mounting arms 92, 94 (see FIG. 1), as by screws. Such mounting arms 92 may be provided with a flange plate 96 to which a fan (not shown) may be fastened. In the illustrated embodiment, the lower mounting arm 92 is a U-shaped bent tube and the upper mounting arm 94 is L-shaped. However, it should be appreciated that the mounting arms 92, 94 could be of a variety of configurations. Moreover, the attachments 90, if not required for mounting arms 92, 94, could be used instead for attaching the fan shroud 86. Still further, it should be appreciated that the fasteners 70 connecting recessed portions 60 and flanges 66 could also be used to assist in attaching the fan shroud 86 and/or mounting arms 92, 94 to the heat exchanger block 10.

Figure 7:
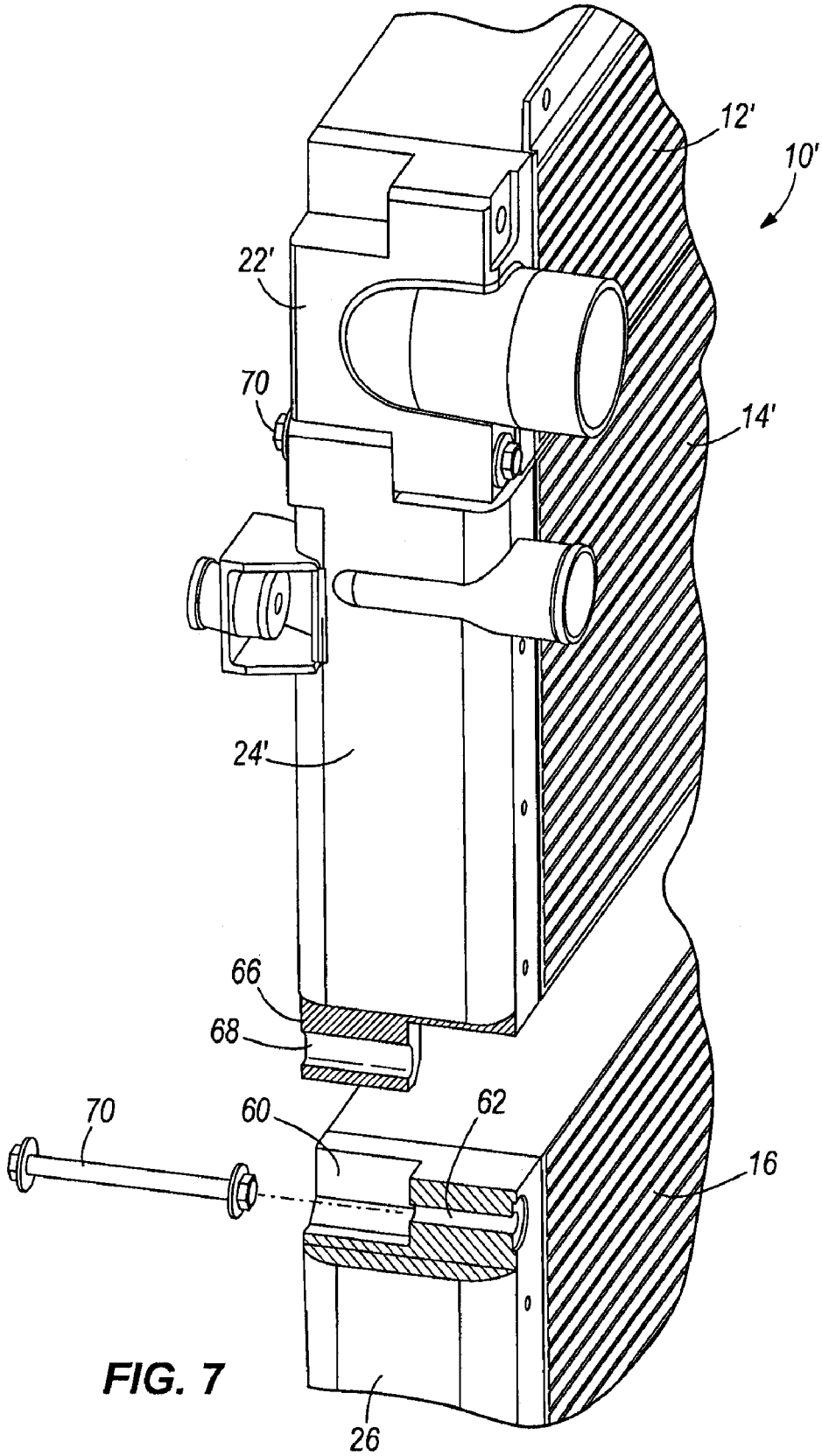
FIG. 7 is an exploded partially cut-away view of another embodiment heat exchanger block according to the present invention.

FIG. 7 illustrates another heat exchanger block 10' similar to the first described embodiment, except that the top and middle heat exchangers 12', 14' are connected with a fastener 70 extending through horizontally aligned openings like the above described connection of the middle and bottom heat exchangers 14, 16 (with the headers 22', 24' accordingly different from the first described embodiment). Such a configuration may be advantageously used, for example, when all the heat exchangers operate roughly in the same temperature range. It should be appreciated that a protrusion beyond the general outer contour of the headers 12', 14' (such as occurs with the FIG. 3 connected flanges 30, 36) may be fully avoided with this structure.

Figure 8:
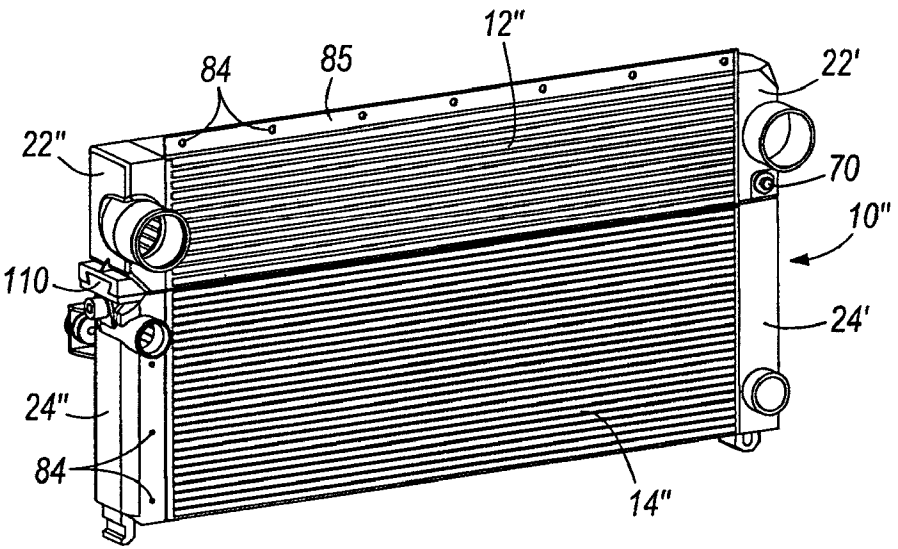
FIG. 8 is a perspective view of a partial heat exchanger block of still another embodiment according to the present invention.
Figure 9:
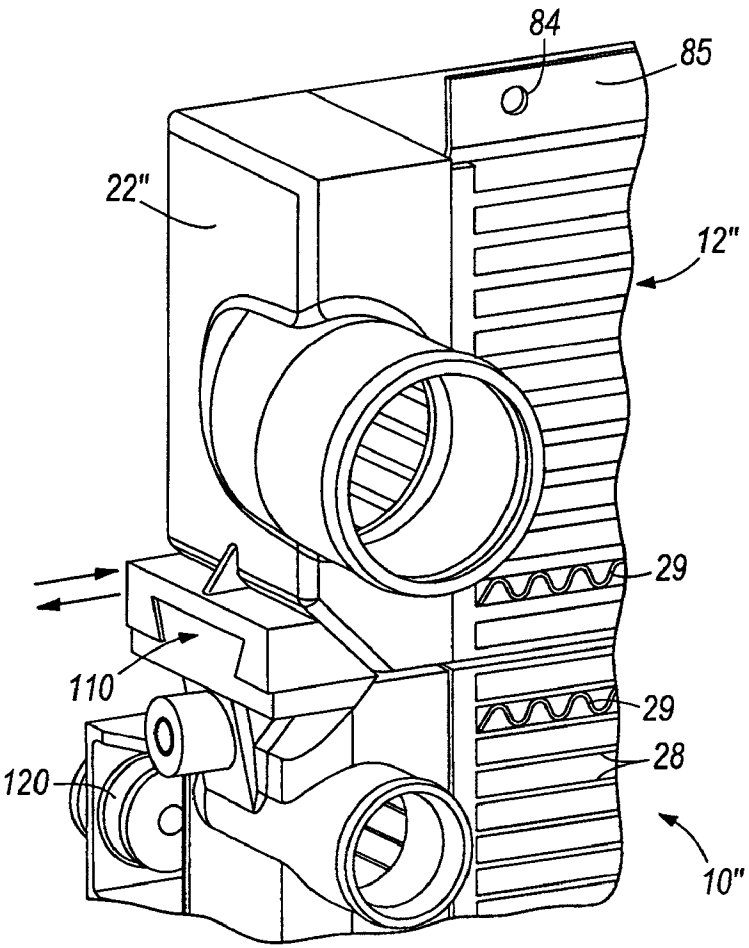
FIG. 9 is an enlarged view of the upper left corner of the heat exchanger block of FIG. 8.

FIGS. 8 and 9 illustrate a heat exchanger block 10" according to still another embodiment of the present invention. In accordance with this embodiment, the headers 22, 24' at one end may be connected using a fastener 70 such as illustrated in FIG. 4, whereas the headers 22", 24" at the opposite end of the connected heat exchangers 12", 14" may be force fit together during the course of positioning the heat exchangers 12", 14" for insertion of the fastener 70 at the other end. As illustrated in FIG. 9, a dove-tail joint 110 may be advantageously used, although it should be appreciated that this is just one example of many force fit connections which may be advantageously used. The joint could be configured in some other appropriate manner, for example, depending on the temperature-related length changes anticipated.

Figure 1:
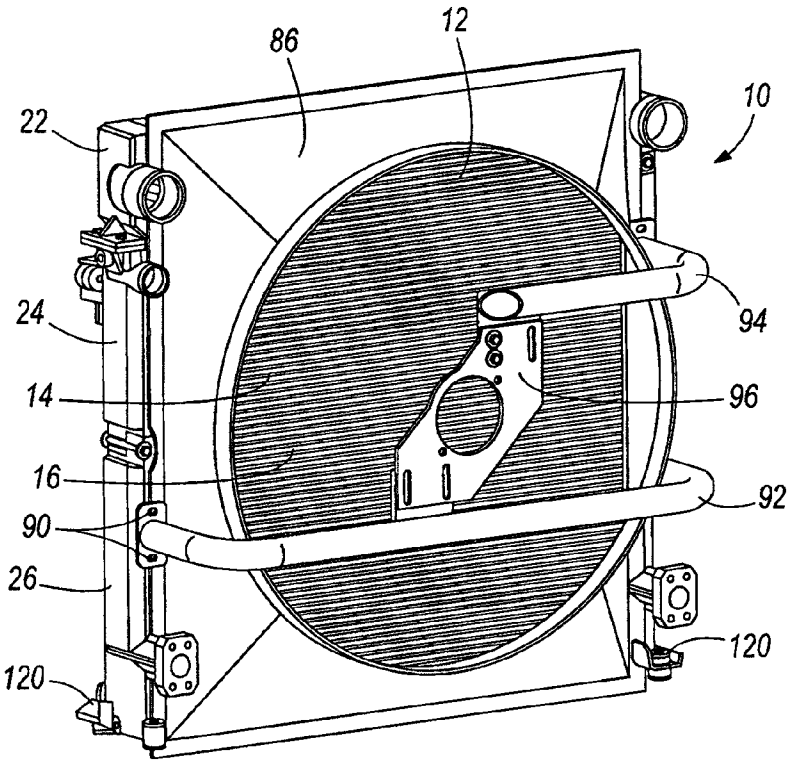
FIG. 1 is a perspective view of a heat exchanger block according to the present invention.

Support of the heat exchanger block 10 in a vehicle may be advantageously achieved by use of dampers 120 arranged directly on one or more of the headers 22, 24, 26 as shown, for example, in FIGS. 1 and 9.

It should be appreciated that heat exchanger blocks according to the invention described herein provide functional properties which are advantageously usable, for example, in the off-highway sector. Further, it should be appreciated that such blocks can be manufactured cost-effectively and modified relatively easily. The present invention may further advantageously provide heat exchanger blocks which may be readily used in a variety of different configurations, where different size individual heat exchangers may be used depending upon the requirements while also limiting the necessity for change and while maintaining a compact configuration. That is, the present invention provides a block structure which is standardizable to a certain degree. Moreover, since no support frames or similar fastening rails are required, heat exchanger blocks according to the present invention are not only compact and space-saving, but the costs for manufacturing the heat exchanger blocks for different applications can be minimized.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A heat exchanger block comprising first and second heat exchangers, the first and second heat exchangers each including a pair of longitudinal headers with flow passages extending between said longitudinal headers, an end of a header of the first heat exchanger positioned adjacent and detachably connected to an end of a header of the second heat exchanger, wherein one of said header ends includes a recessed portion and a hole, an other of said header ends includes a flange receivable in said recessed portion and a hole through the flange aligned with the hole of the one header end; and a fastener received in said aligned holes;

wherein an internal volume defined by the header of the first heat exchanger is fluidly isolated from an internal volume defined by the header of the second heat exchanger.

2. The heat exchanger block of claim 1, wherein at least some of said longitudinal headers are aluminum cast parts.

3. The heat exchanger block of claim 1, further comprising shroud attachments along a longitudinal wall of at least one of the longitudinal headers.

4. The heat exchanger block of claim 1, further comprising a thermally insulative insert between the flow passages of said first and second heat exchangers.

5. The heat exchanger block of claim 1, wherein the fastener extends between a front and a back of the heat exchanger block in a direction generally perpendicular to both the flow passages and the longitudinal dimension of the longitudinal headers.

6. The heat exchanger block of claim 1, wherein each of said holes have an oblong cross-section in a plane perpendicular to an axial dimension of said holes.

7. The heat exchanger block of claim 6, wherein said oblong cross-section of each hole has a maximum diameter in the plane, and said maximum diameter of the oblong cross-section of one hole is transverse to said maximum diameter of the oblong cross-section of an other hole.

8. The heat exchanger block of claim 1, wherein said heat exchanger block is a cross-flow heat exchanger block in which the longitudinal headers of the first and second heat exchangers are arranged in two aligned rows.

9. The heat exchanger block of claim 1, wherein the end of the header of the first heat exchanger and the end of the header of the second heat exchanger jointly define a substantially longitudinally extending outer profile, and said flange does not extend substantially outside said outer profile.

10. The heat exchanger block of claim 1, wherein said flow passages together with fins define a core for each of the first and second heat exchangers, and a side of the first heat exchanger core and a side of the second heat core are substantially aligned in a single plane.

11. The heat exchanger block of claim 10, wherein said flange extends substantially parallel to said plane.

12. The heat exchanger block of claim 1, further comprising fan mounting arms and arm attachments along a longitudinal wall of at least one of the longitudinal headers.

13. A heat exchanger block comprising:

a first heat exchanger having a first header from which tubes extend, the first header having an end from which a flange extends, and an aperture defined through the flange, the first heat exchanger defining a portion of a fluid circuit of a first fluid to be cooled;

a second heat exchanger having a second header from which tubes extend, the second header having an end, and an aperture defined through a portion of the end of the second header, the second heat exchanger defining a portion of a fluid circuit of a second fluid to be cooled, the second fluid circuit fluidly isolated from the first fluid circuit;

the end of the first header of the first heat exchanger positioned adjacent the end of the second header of the second heat exchanger such that the apertures are in alignment; and a fastener positioned through the aligned apertures in order to detachably connect the first and second heat exchangers.

14. The heat exchanger block of claim 13, wherein the portion of the end of the second heat exchanger is a flange, and wherein a sliding seat is associated with the fastener.

15. The heat exchanger block of claim 13, wherein at least one of the first and second heat exchanger ends further comprises a second aperture through which another fastener is positioned.

16. The heat exchanger block of claim 13, wherein at least one of the aligned apertures has an oblong cross-section in a plane perpendicular to an axial dimension of the aperture.

17. The heat exchanger block of claim 13, wherein the adjacent first and second headers of the heat exchanger block jointly define a substantially longitudinally extending outer profile, and the flange does not extend substantially outside the outer profile.

18. The heat exchanger block of claim 13, wherein the tubes of each of the first and second heat exchangers define a respective core of each heat exchanger, and a side of the first heat exchanger core and a side of the second heat exchanger core are substantially aligned in a single plane.

19. The heat exchanger block of claim 13, wherein the first heat exchanger has a second header having an end adapted for connection to an end of a first header of the second heat exchanger.

20. The heat exchanger block of claim 13, wherein the header of at least one of the first and second heat exchangers defines a tank substantially enclosing an internal volume for a working fluid.

21. The heat exchanger block of claim 13, wherein the fastener prevents relative movement between the headers of the first and second heat exchangers in one direction and allows relative movement between the headers in a direction perpendicular to the one direction.

22. A heat exchanger block comprising:

a first heat exchanger with a first header defining an interior volume and forming a manifold for fluid flow, an end of the first header having an engagement element;

a second heat exchanger with a second header defining an interior volume and forming a manifold for fluid flow, the interior volume of the first header being fluidly isolated from the interior volume of the second header, an end of the second header having an engagement element that corresponds to the engagement element of the first heat exchanger;

wherein the first heat exchanger is positioned adjacent the second heat exchanger and the engagement element of the first heat exchanger is secured to the engagement element of the second heat exchanger in order to allow limited movement of the first heat exchanger relative to the second heat exchanger.

23. The heat exchanger block of claim 22, wherein the engagement element of the first heat exchanger is a flange with at least one aperture.

24. The heat exchanger block of claim 23, and further comprising a sliding seat proximate to the engagement element of the first and second heat exchangers.

25. The heat exchanger block of claim 23, wherein the engagement element of the second heat exchanger comprises a recess and an adjacent portion of the end of the second header having an aperture, and a connector is positioned through the apertures in the first and second header ends.

26. The heat exchanger block of claim 23, wherein the engagement element of the second heat exchanger is a flange which abuts the flange of the first heat exchanger, the flange of the second heat exchanger having at least one aperture and being positioned such that the apertures are aligned to receive a connector.

27. The heat exchanger block of claim 26, and further comprising a sleeve at least partially surrounding the connector.

28. The heat exchanger block of claim 22, wherein the engagement element of the first heat exchanger is connected to the engagement element of the second heat exchanger such that expansion and contraction of heat exchanger components due to temperature fluctuations are accommodated.

29. The heat exchanger block of claim 22, wherein the first and second headers of the heat exchanger block jointly define a substantially longitudinally extending outer profile, and the engagement elements are positioned substantially within the outer profile.

30. The heat exchanger block of claim 22, wherein each of the first and second heat exchangers includes a core, and a side of the first heat exchanger core and a side of the second heat exchanger core are substantially aligned in a single plane.

31. The heat exchanger block of claim 22, wherein the first heat exchanger has a second header and the second heat exchanger has a first header, the second header having an end adapted to be removeably secured to an end of the first header of the second heat exchanger.

32. The heat exchanger block of claim 22, wherein a thermally insulative insert is positioned between adjacent portions of the first and second heat exchangers.

33. The heat exchanger block of claim 22, wherein the engagement element of the first heat exchanger is in contact with the engagement element of the second heat exchanger.

34. A method of forming a heat exchanger block from a first heat exchanger comprising a portion of a fluid circuit for cooling a first fluid and a second heat exchanger comprising a portion of a fluid circuit for cooling a second fluid which is fluidly isolated from the fluid circuit for the first fluid, the method comprising the acts of:

providing the first heat exchanger with a first header having an end with a flange and a first aperture defined through the flange, and the second heat exchanger with a second header having an end through which a second aperture is defined;

positioning the first and second headers such that the first and second apertures are in alignment; and removably connecting the first and second headers of the first and second heat exchangers with a fastener inserted through the aligned first and second apertures.

35. The method of claim 34, and further comprising:

allowing for at least one of expansion and contraction of components of the heat exchanger due to thermal cycling by providing elasticity at the connection between the first and second headers of the first and second heat exchangers.

36. The method of claim 34, and further comprising:

providing a first heat exchanger core extends from the first header and a second heat exchanger core extends from the second header; and positioning the first and second headers such that a side of the first heat exchanger core and a side of the second heat exchanger core are aligned in a single plane.

37. The method of claim 36, and further comprising:

securing a fan shroud to attachment portions around a perimeter of the heat exchanger block on the sides aligned in a single plane.

38. The method of claim 34, and further comprising:

insulating the first heat exchanger from the second heat exchanger by providing a thermally insulative insert between adjacent portions of the heat exchangers.

39. The method of claim 34, and further comprising:

providing dampers for mounting the heat exchanger block such that the heat exchanger block is substantially isolated from at least one of external movement and vibrations.

* * * * *